US010132475B2

(12) United States Patent
Engle et al.

(10) Patent No.: US 10,132,475 B2
(45) Date of Patent: Nov. 20, 2018

(54) BAY LUMINAIRE WITH INTERCHANGEABLE HOUSING COMPONENTS

(71) Applicant: Hubbell Incorporated, Shelton, CT (US)

(72) Inventors: Joseph Engle, Taylors, SC (US); Thomas Holscher, Simpsonville, SC (US); Dustin Parsons, Greer, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/494,936

(22) Filed: Apr. 24, 2017

(65) Prior Publication Data

US 2017/0307181 A1 Oct. 26, 2017

Related U.S. Application Data

(60) Provisional application No. 62/326,379, filed on Apr. 22, 2016.

(51) Int. Cl.

| | |
|---|---|
| ***F21V 17/00*** | (2006.01) |
| ***F21V 29/505*** | (2015.01) |
| ***F21V 29/507*** | (2015.01) |
| ***F21V 29/76*** | (2015.01) |
| ***F21V 15/01*** | (2006.01) |
| ***F21S 8/04*** | (2006.01) |
| *F21Y 115/10* | (2016.01) |

(52) U.S. Cl.

CPC ..... *F21V 17/002* (2013.01); *F21S 8/04* (2013.01); *F21V 15/012* (2013.01); *F21V 29/505* (2015.01); *F21V 29/507* (2015.01); *F21V 29/763* (2015.01); *F21Y 2115/10* (2016.08)

(58) Field of Classification Search

CPC .... F21V 17/002; F21V 29/763; F21V 29/503; F21V 29/505; F21V 29/507; F21V 15/012; F21Y 2115/10

See application file for complete search history.

(56) References Cited

U.S. PATENT DOCUMENTS

| | | | | |
|---|---|---|---|---|
| 3,636,339 | A * | 1/1972 | Osborne, Jr. ..... | F21V 15/01 29/445 |
| 4,812,958 | A | 3/1989 | Rolfe et al. | |
| 5,590,956 | A | 1/1997 | Messana et al. | |
| 2011/0170294 | A1* | 7/2011 | Mier-Langner ..... | F21S 8/02 362/294 |
| 2015/0296638 | A1 | 10/2015 | Wu et al. | |

OTHER PUBLICATIONS

PCT/US2017/029081 International Search Report and Written Opinion dated Jul. 5, 2017 (15 pages).

* cited by examiner

*Primary Examiner* — Kevin Quarterman

(74) *Attorney, Agent, or Firm* — Michael Best & Friedrich, LLP

(57) ABSTRACT

A luminaire includes a light emitter and a housing connected to a heat sink. The housing is made from two different types of panels and retains one or more control components. The luminaire can also include a heat sink which connects the housing and the light emitter.

19 Claims, 7 Drawing Sheets

BAY LUMINAIRE WITH INTERCHANGEABLE HOUSING COMPONENTS

RELATED APPLICATION(S)

This application is based on U.S. provisional application Ser. No. 62/326,379, filed Apr. 22, 2016, the disclosure of which is incorporated herein by reference in its entirety and to which priority is claimed.

FIELD

Various exemplary embodiments relate to light fixtures or luminaires, for example indoor luminaires used in commercial or industrial applications.

BACKGROUND

Light fixtures, or luminaires, are used with electric light sources to provide an aesthetic and functional housing in both interior and exterior lighting applications. For example, high bay luminaires can be used in larger open indoor environments such as heavy industrial settings, warehouses, gyms, churches, and shopping malls. Conventional high bay lighting fixtures for commercial and industrial applications are often mounted or suspended from ceiling joists high above the floor.

SUMMARY

According to an exemplary embodiment, a high-bay luminaire includes a heat sink having a base with a substantially disc-shaped configuration. A light emitter is connected to the heat sink. A reflector is connected to the heat sink. A housing is connected to the heat sink. The housing has a wall formed from a first set of panels and a second set of panels. The second set of panels is releasably connected to the first set of panels. A control component is positioned in the housing.

According to another exemplary embodiment, a high-bay luminaire includes a first mounting panel having an outer wall. A first outer arm extends from the outer wall, and a second outer arm extends from the outer wall. The first outer arm at least partially defines a first slot. A first panel is positioned in the slot to removably connect to the first mounting panel. The first mounting panel and the second panel at least partially define a housing. A control component is positioned in the housing. A light emitter is operatively connected to the control component.

According to another exemplary embodiment, a high-bay luminaire includes a heat sink comprising a base having a plurality of heat fins extending from an outer portion to an inner portion, a lower recessed portion, and a wall extending from the base in a direction opposite the lower recessed portion to define a junction compartment. A light emitter is connected to the lower recessed portion. A housing is connected to the heat sink. A control component is positioned in the housing. The control component can be electrically connected to the light emitter through a connection made in the junction compartment.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
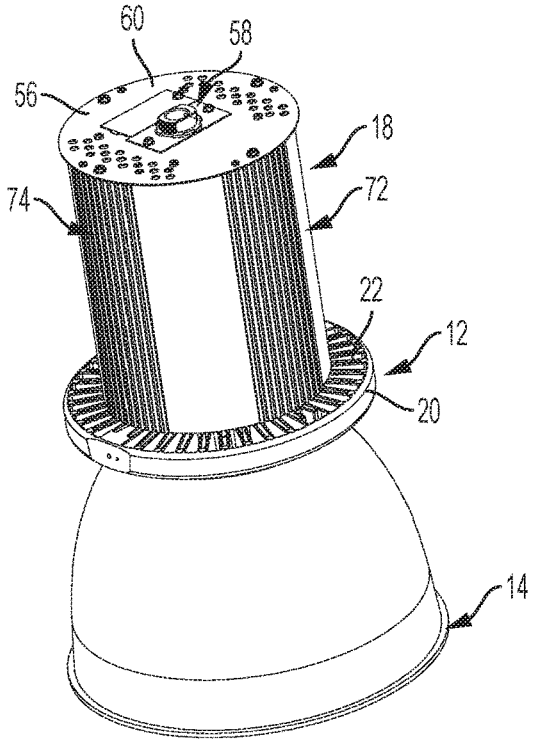
FIG. 1 is a side perspective view of an exemplary luminaire.

FIG. 1 shows an exemplary embodiment of a bay luminaire generally having a heat sink 12, an optical component or assembly, for example a reflector 14, a light emitter 16, and an upper housing 18 containing one or more control components. The reflector 14, light emitter 16, and upper housing 18 are connected to the heat sink 12. The type of reflector 14 can be changed or removed entirely to provide a desired light output as would be understood by one of ordinary skill in the art. Different outer lenses (not shown) can also be connected to the reflector 14 or to the heat sink 12.

Figure 2:
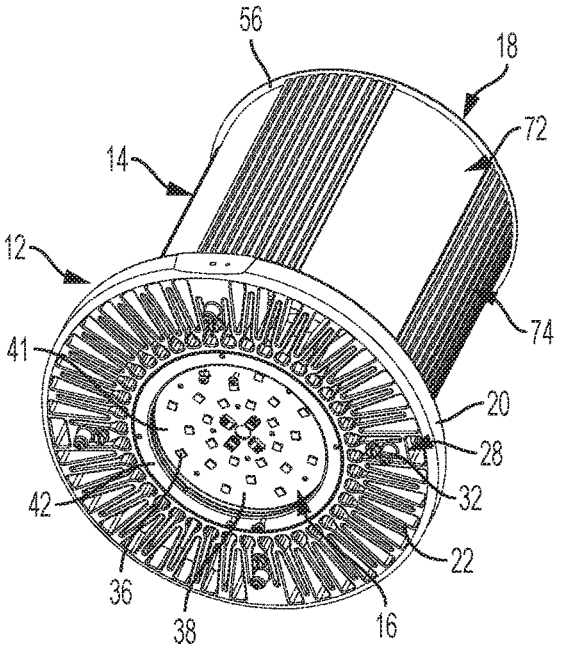
FIG. 2 is a bottom perspective view of the luminaire of FIG. 1 with the reflector removed.
Figure 3:
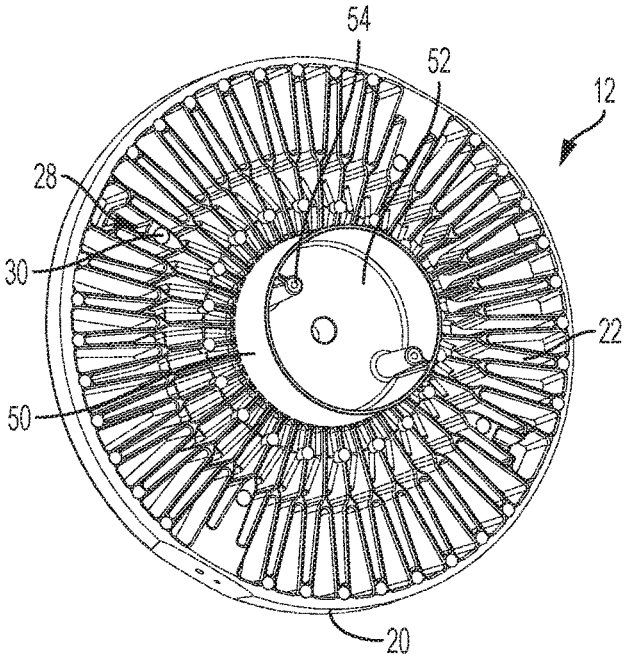
FIG. 3 is a top perspective view of the heat sink of FIG. 1.
Figure 4:
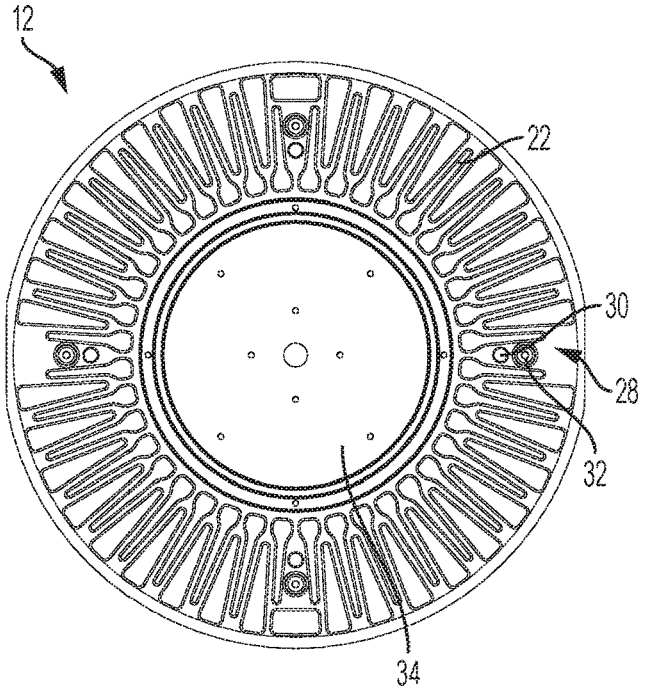
FIG. 4 is a bottom view of FIG. 3.

FIGS. 2-4 show an exemplary heat sink 12 having a base with a substantially disc-shaped configuration and a substantially circular outer portion 20. A plurality of heat fins 22 extend from the outer portion 20 to an inner portion of the heat sink 12. The heat fins 22 have a substantially Y-shape configuration with a base portion positioned towards the interior of the heat skink 16 splitting into two tines which diverge as they extend toward the outer portion 20. Different sizes, shapes, and configurations of heat fins 22 can also be used depending on the desired thermal characteristics. One or more mounting portions 28 are provide between the heat fins 22 to receive different components associated with the luminaire. In this exemplary embodiment, four mounting portions 28 are used, with each mounting portion 28 having an upper boss 30 for connecting components to the top of the heat sink 12 and a lower boss 32 for connecting one or more components to the bottom of the heat sink 12. The size, shape, and configuration of the heat sink 12 can be modified for different applications.

The bottom of the heat sink 12 includes a lower recessed portion 34 for receiving the light emitter 16. In an exemplary embodiment, the light emitter 16 includes a plurality of LEDs 36 connected to a PCB 38. A backing (not shown) can be placed between the light emitter 16 and the heat sink 12. The backing can be made from different materials to provide insulation or increased heat transfers depending on the needed thermal characteristics. The light emitter 16 can be connected by one or more fasteners extending into the lower recessed portion 34. A lens 40 can also be connected to the heat sink 12 over the light emitter 16. In this example a mounting ring 42 is used connected to the heat sink 12 to hold the lens 40 in place. A gasket can be positioned between the mounting ring 42 and the heat sink 12 and the lower recessed portion 34 can include a number of stepped rims to define different widths for receiving the light emitter 16, the lens 40, and the mounting ring 42, as shown in FIGS. 4 and 5.

Other optical elements, including additional inner reflectors can be connected around the light emitter 16. For example, an adapter plate 44 can be connected to the lower bosses 32 on the heat sink 12. The adapter plate 44 can be configured to connect different reflector and lens combinations to the heat sink 12. As shown in FIGS. 5 and 6, the adapter plate 44 includes a set of outer openings that connect to the heat sink 12 and an inner tab 46 having openings that connect to a reflector mount 48. The reflector mount 48 in turn supports the reflector 14. The reflector mount 48 can be plain or it can have one or more optical features or components that are used to direct, diffuse, or otherwise control or alter the light output. In some embodiments, the reflector 14, adapter plate 44, inner reflector 48, or any combination thereof can be releasably connected using keyhole slots, snap-fit connections, twist connections, or other mechanical connections that can allow for quick removal without a tool. Other embodiments can also include various lenses or other optical components connected to the heat sink via the adapter plate, either directly or through additional mounting features.

Figure 5:
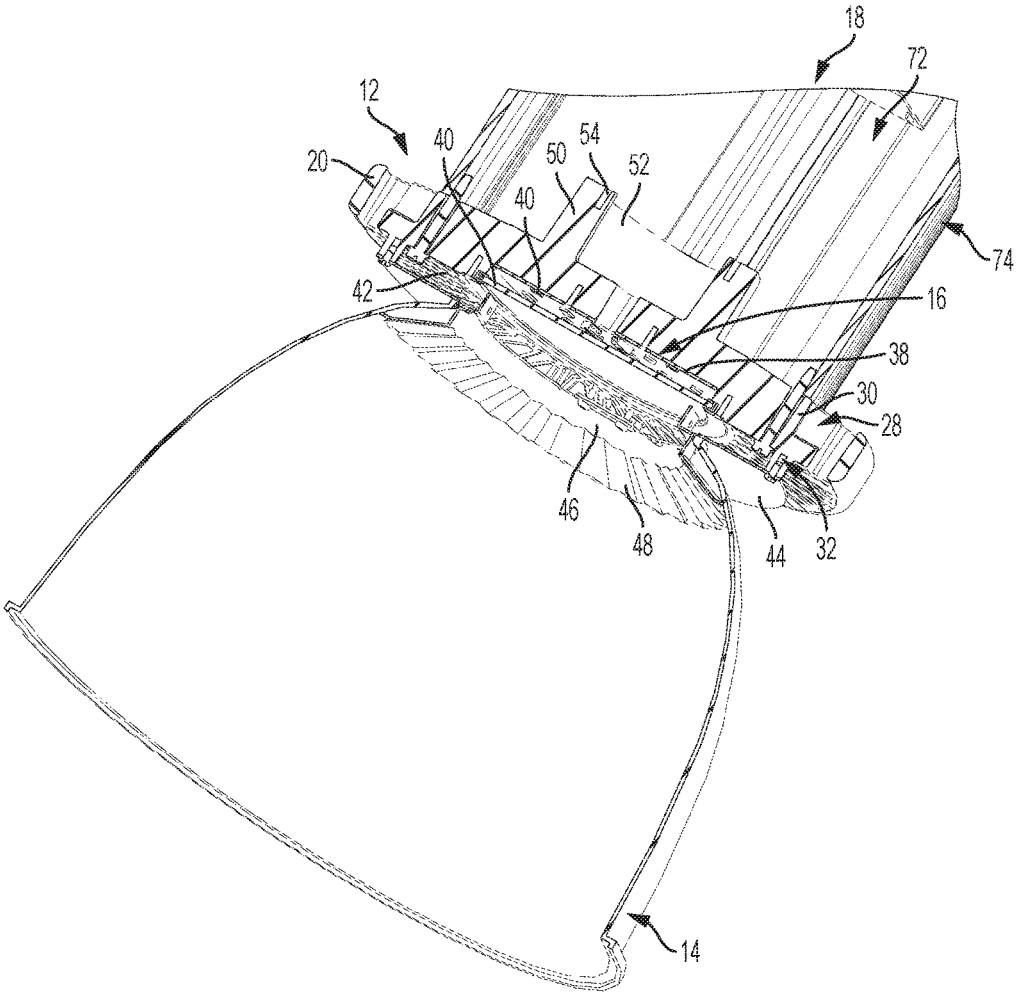
FIG. 5 is a sectional view of FIG. 1.
Figure 6:
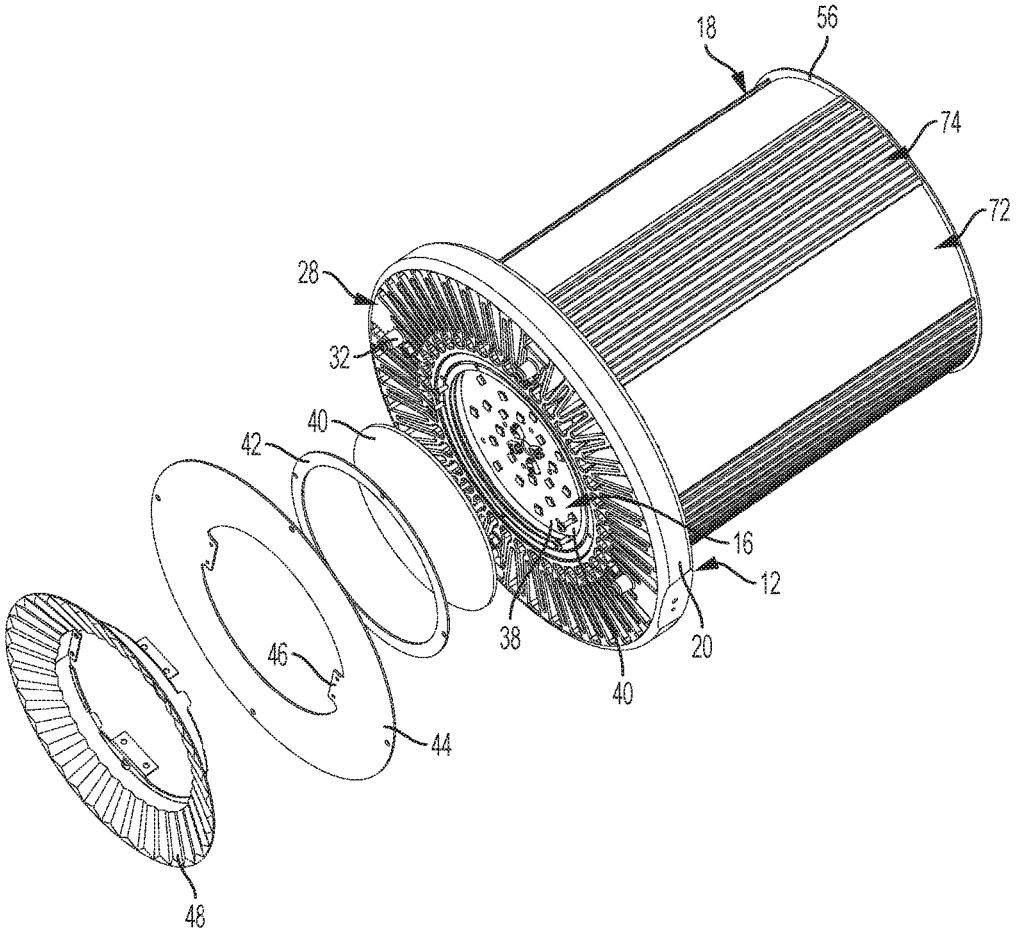
FIG. 6 is a partially exploded view of FIG. 2.
Figure 7:
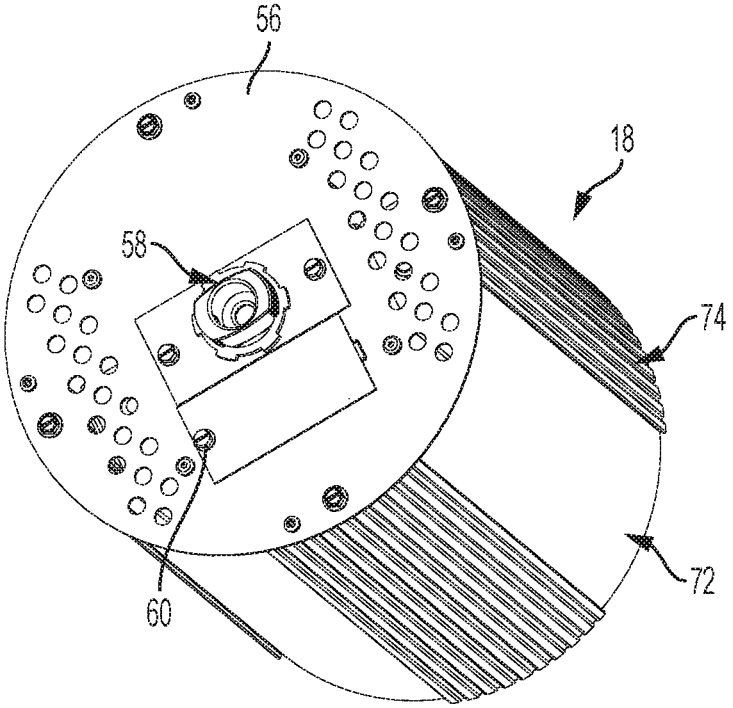
FIG. 7 is a top perspective view of the upper housing components of FIG. 1.
Figure 8:
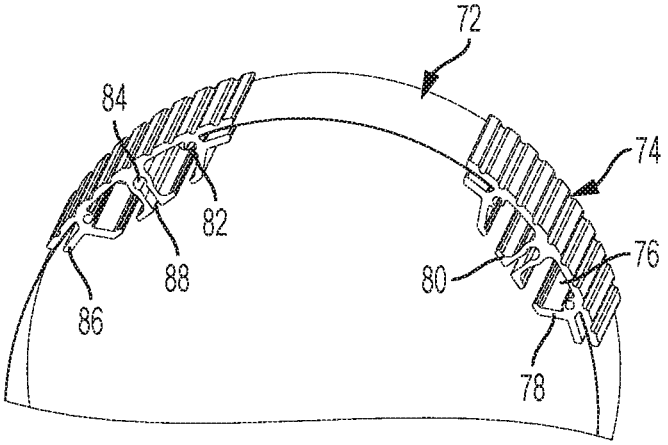
FIG. 8 is a bottom perspective, enlarged view of the first and second panels of FIG. 7.

As best shown in FIGS. 3 and 5, a cylindrical wall 50 extends from an upper portion of the heat sink 12 to define a recessed area 52. The recessed area 52 can act as a junction housing to make an electrical connection between the light emitter 16 and one or more control components. One or more bosses 54 are positioned in the recessed area 52. A plate having a diameter substantially equal with the outer edge of the cylindrical wall 50 can be connected over the recessed area 52 using fasteners that extend into the bosses 54. The upper housing 18 is connected to the heat sink 12 extending around the cylindrical wall 50. For example, a fastener can extend through the upper boss to secure the upper housing 18 to the heat sink 12.

According to an exemplary embodiment, the upper housing 18 includes a first type of side panels, and a second type of side panels. The first and second panels are shown as connected in an alternating fashion and having a substantially cylindrical configuration. According to various exemplary embodiments, other sizes, shapes, configurations, and positions of the first and second panels can be used. Fewer or more of each panel can also be used. As discussed in further detail below the first type of panel can be a decorative panel 72 and the second type of panel can be a mounting panel 74.

The upper housing 18 also includes a top wall 56. A mounting component 58 is provided in, or connected to, the top wall 56. For example, the mounting component 58 can include an external threaded portion and an internal threaded aperture to receive a standard hook mount or a pendant mount. A removable panel or door 60 can be provided in the top wall 56 to allow conductors to be run into the upper housing 18.

A junction box 62 extends from the top wall 56 into the upper housing 18. The junction box includes a bottom wall 64 and four side walls 66. Electrical conductors can extend from a power supply into the junction box 64. One or more openings are provided in one or more of the side walls 66 to allow additional conductors to extend to control components, such as drivers, positioned outside of the junction box 62. Other control components, such as a fuse and a surge protector can be positioned inside of the junction box 62. Additional control components, such as sensors and control modules (for example a wireless control module) that are used to power, monitor, and/or control the operation of the light emitters 16 can be positioned inside of the junction box 62 or elsewhere in the upper housing 18.

In an exemplary embodiment, the first type of side panels can be a decorative panel 72. The decorative panel 72 can include colors, patterns, logos, wording, or other indicia that can be customized by a user. The decorative panel 72 is removable connected to the second type of side panels, so that different decorative panels can be interchanged as needed.

Figure 9:
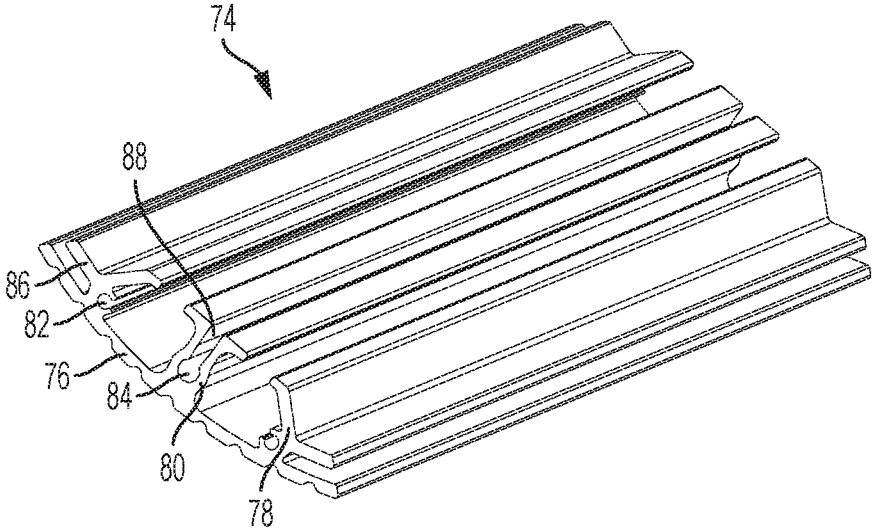
FIG. 9 is a perspective view of the mounting panel.
Figure 10:
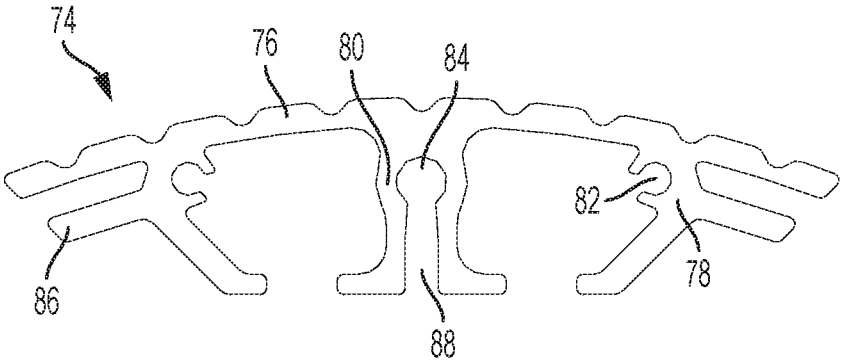
FIG. 10 is a bottom view of FIG. 9.

In an exemplary embodiment, the second type of side panels can be mounting panels 74 that are used to connect and retain various components as well as connect the upper housing 18 to the heat sink 12. As best shown in FIGS. 9 and 10, the mounting panels 74 include an outer wall 76. The outer wall 76 can be provided with a ribbed or corrugated surface to increase heat transfer. Fins can also be provided on the outer wall 76.

One or more protrusions extend from the outer wall 76 inside of the upper housing 18. The protrusions are shown as a pair of outer arms 78 and a pair of central arms 80 extending from the outer wall 76. The outer wall 76, outer arms 78, and central arms 80 at least partially define one or more connecting features, for example mounting connecting features, panel connecting features, and control component connecting features.

In an exemplary embodiment, the outer arms 78 have a substantially C-shaped portion defining an outer groove 82 for receiving fasteners, such as screws or bolts. Components, such as the top wall 56, can be mounted to the outer arms 78 using fastener extending into the outer grooves 56. The central arms 80 define a central groove 84 that can, for example, receive fasteners that mount the top wall 56 to the mounting panels 74 and mount the mounting panels 74 to the heat sink 12.

The outer arms 78 also include tabs 86. The tabs 86 and the outer wall 76 at least partially define a slot configured to receive the decorative panels 72. Both the decorative panels 72 and the mounting panels 74 are curved so that when connected together they from a substantially cylindrical configuration surrounding an open interior. Accordingly the curve of both panels 72, 74 can have the same radius of curvature. In other embodiments, other configurations can also be used.

The central arms 80 also define a channel 88 that is configured to receive one or more fasteners, for example a threaded fastener, from a direction substantially perpendicular to the length of the channel 88. One or more control components can be connected to channel 88, either directly or through various mounting bracket. Other fasteners, such as clips, brackets, plates, or other features or components can be used to connect the control components.

Different drivers can be connected to the channel 88 either alone or in different combinations. The drivers 90A, 90B are positioned to extend along the mounting panels 74, for example in a substantially vertical orientation. In other exemplary embodiments, one or more brackets can be used and connected to the mounting panels 74 so that the drivers are in a horizontal orientation, extending across the interior of the upper housing 18.

Figure 11:
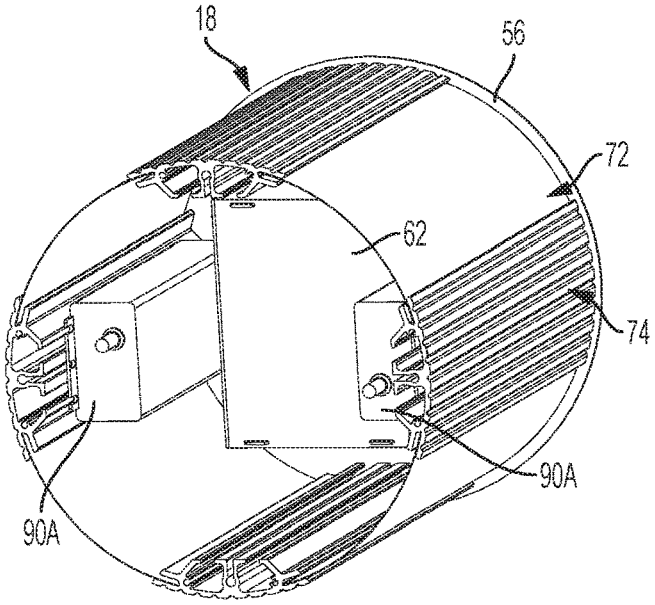
FIG. 11 is a bottom perspective view of the upper housing and an exemplary set of control components.
Figure 12:
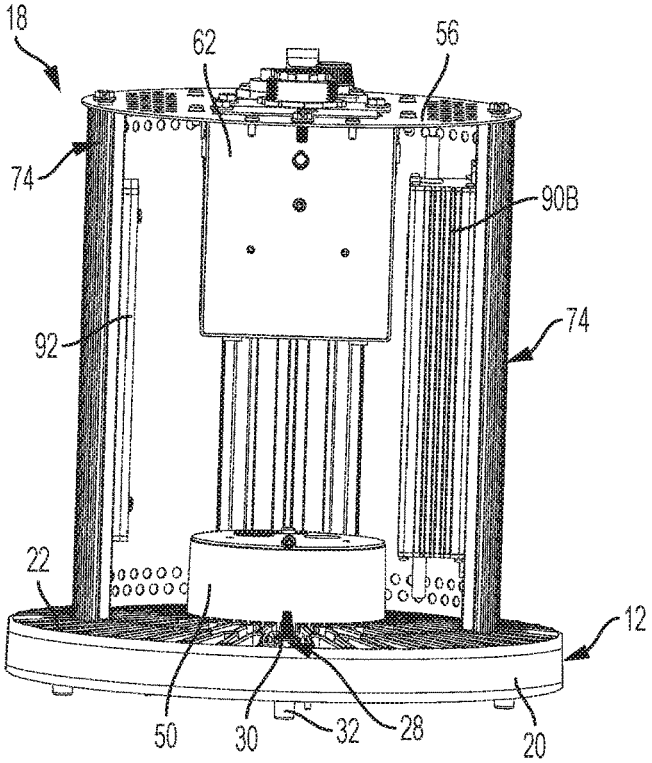
FIG. 12 is a side view of an exemplary upper housing with some of the panels removed to show another exemplary set of control components.

Different types of drivers and different numbers of drivers can be used depending on the desired light output. FIG. 11 shows an exemplary embodiment utilizing a pair of a first type of drivers 90A. The first drivers 90A are connected to opposite mounting panel 74, equally distributing their weight to balance the luminaire. FIG. 12 shows an exemplary embodiment using only a single driver 90B connected to one of the mounting panels 74. When the single driver 90B is used, one or more counter weights 92 can be connected to a mounting panel 74 opposite the driver 90B. In an exemplary embodiment, the counter weight 92 can include one or more plates connected to a mounting panel 74 in a manner similar to the driver 90B to balance the luminaire.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed is:

1. A high-bay luminaire comprising:

a heat sink having a base with a substantially disc-shaped configuration;

a light emitter connected to the heat sink;

a reflector connected to the heat sink;

a housing connected to the heat sink, the housing having a wall formed from a first set of panels and a second set of panels, wherein the second set of panels is releasably connected to the first set of panels; and a control component positioned in the housing.

2. The luminaire of claim 1, wherein the first set of panels has a first configuration and the second set of panels has a second configuration different from the first configuration.

3. The luminaire of claim 1, wherein the first panel is a decorative panel and the second panel is a mounting panel configured to connect to the heat sink.

4. The luminaire of claim 3, wherein the control component is connected to the mounting panel.

5. The luminaire of claim 1, wherein the housing includes a top wall and a junction box is connected to the top wall.

6. The luminaire of claim 1, wherein the heat sink includes a cylindrical wall extending from a base and surrounding a recessed portion.

7. The luminaire of claim 1, further comprising an adaptor plate connected to the heat sink and wherein the adaptor plate connects the reflector to the heat sink.

8. A high-bay luminaire comprising:

a first mounting panel having an outer wall, a first outer arm extending from the outer wall, and a second outer arm extending from the outer wall, wherein the first outer arm at least partially defines a first slot;

a first panel positioned in the slot to removably connect to the first mounting panel, wherein the first mounting panel and the first panel at least partially define a housing;

a control component positioned in the housing; and a light emitter operatively connected to the control component, wherein the first mounting panel includes a pair of central arms defining a channel and wherein the control component is connected to the channel.

9. The luminaire of claim 8, wherein the pair of central arms define a central groove configured to receive a fastener.

10. The luminaire of claim 9, further comprising a heat sink connected to the first mounting panel by a fastener extending into the central groove.

11. The luminaire of claim 10, wherein the heat sink includes a base having a substantially disc-shaped configuration with a plurality of heat fins extending from an outer portion to an inner portion, a lower recessed portion receiving the light emitter, and a wall extending from the base in a direction opposite the recessed portion.

12. The luminaire of claim 8, further comprising a second mounting panel positioned opposite the first mounting panel and a second panel positioned opposite the first panel.

13. The luminaire of claim 12, further comprising a driver connected to the second mounting panel.

14. The luminaire of claim 12, further comprising a counterweight connected to the second mounting panel.

15. A high-bay luminaire comprising:

a heat sink comprising a base having a plurality of heat fins extending from an outer portion to an inner portion, a lower recessed portion, and a wall extending from the base in a direction opposite the lower recessed portion to define a junction compartment;

a light emitter connected to the lower recessed portion;

a housing connected to the heat sink;

a control component positioned in the housing, wherein the control component can be electrically connected to the light emitter through a connection made in the junction compartment.

16. The luminaire of claim 15, wherein the heat sink includes a plurality of mounting portions including an upper boss and a lower boss, wherein the upper boss receives a fastener connecting the heat sink to the housing and the lower boss receives a fastener connecting an optical assembly to the heat sink.

17. The luminaire of claim 15, further comprising an adapter plate connected to the heat sink and an optical component connected to the adapter plate.

18. The luminaire of claim 17, wherein the optical component includes a reflector connected to the adapter plate by a reflector mount.

19. The luminaire of claim 15, wherein the housing includes a wall formed from a first set of panels and a second set of panels, wherein the second set of panels is releasably connected to the first set of panels, and wherein the first set of panels has a first configuration and the second set of panels has a second configuration different than the first configuration.

* * * * *